US006499451B1

(12) United States Patent
Hendriksma et al.

(10) Patent No.: US 6,499,451 B1
(45) Date of Patent: Dec. 31, 2002

(54) CONTROL SYSTEM FOR VARIABLE ACTIVATION OF INTAKE VALVES IN AN INTERNAL COMBUSTION ENGINE

(75) Inventors: Nick J. Hendriksma, Grand Rapids, MI (US); Wayne S. Harris, Hilton, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/023,106

(22) Filed: Dec. 17, 2001

(51) Int. Cl.[7] ..... F01L 13/00

(52) U.S. Cl. ..... 123/90.16; 123/90.38; 123/198 F

(58) Field of Search ..... 123/90.11, 90.15, 123/90.16, 90.17, 90.38, 90.39, 90.41, 198 F

(56) References Cited

U.S. PATENT DOCUMENTS 4,151,817 A * 5/1979 Mueller ..... 123/90.16
4,221,200 A * 9/1980 Soeters, Jr. ..... 123/90.16
5,529,033 A * 6/1996 Hampton ..... 123/90.16
5,619,958 A * 4/1997 Hampton et al. ..... 123/90.16
5,623,897 A * 4/1997 Hampton et al. ..... 123/90.16
5,653,198 A 8/1997 Diggs
6,318,318 B1 * 11/2001 Jahr ..... 123/90.16

* cited by examiner

*Primary Examiner*—Wellun Lo
(74) *Attorney, Agent, or Firm*—Patrick M. Griffin

(57) ABSTRACT

A control system for variable activation of valves in an internal combustion engine. A solenoid is disposed on the outer surface of the valve cam cover to avoid exposure to the hot-oil environment within the valve activation chamber. The solenoid armature extends through the cam cover into the valve activation chamber. A bellcrank is mounted between the solenoid armature and the latching pin of a latchable cam finger follower such that energizing and de-energizing of the solenoid causes corresponding actuation and deactuation of the finger follower, which may be suitable for high-lift and low-lift activation. Preferably, the bellcrank is compliant such that when the solenoid is actuated during the lift portion of the valve cycle the pin is placed under compression so that the pin is subsequently actuated into latching position when the follower moves to the base circle portion of the valve cam. Preferably, for a plurality of such systems on an individual engine, the solenoids are provided with connecting pins on an upper surface thereof and are held in place by a retainer containing an overmolded wiring bundle which automatically connects correctly to each solenoid upon installation of the retainer onto the engine.

6 Claims, 6 Drawing Sheets

CONTROL SYSTEM FOR VARIABLE ACTIVATION OF INTAKE VALVES IN AN INTERNAL COMBUSTION ENGINE

TECHNICAL FIELD

The present invention relates to internal combustion engines; more particularly, to devices for controlling the variable activation of intake valves in an internal combustion engine; and most particularly, to a system for controllably activating and deactivating a finger follower for a double-lobed cam in an internal combustion engine between high valve lift and low valve lift modes.

BACKGROUND OF THE INVENTION

Internal combustion engines are well known. In an overhead valve engine, the valves may be actuated directly by camshafts disposed on the head itself, or the camshaft(s) may be disposed within the engine block and may actuate the valves via a valve train which may include valve lifters, pushrods, and rocker arms.

It is known that for a portion of the duty cycle of a typical multiple-cylinder engine, the performance load can be met by a functionally smaller engine having fewer firing cylinders, and that at low-demand times fuel efficiency can be improved if one or more cylinders of a larger engine can be withdrawn from firing service. It is also known that at times of low torque demand, valves may be opened to only a low lift position to conserve fuel, and that at times of high torque demand, the valves may be opened wider to a high lift position to admit more fuel. It is known in the art to accomplish this by de-activating a portion of the valve train associated with pre-selected cylinders in any of various ways, such as by providing a special cam finger follower having a latching pin or slide which may be activated and/or deactivated electromechanically. The cam finger follower is so configured that it causes no lift (with a single-lobed cam) or low lift (with a double-lobed cam) of the valve when the pin is disengaged, and high lift of the valve when the pin is engaged.

Various methods for actuating this type of latching pin or slide are known. For example, U.S. Pat. No. 5,544,626 discloses a hydraulic apparatus and return spring for latching and delatching a latching pin. The latching pin is disposed in, and extends from, a bore in an outer finger arm which is supported by a hydraulic lash adjuster. When moved radially inwards of the outer finger arm, the pin engages an inner finger arm which is supported by the valve stem. When valve deactivation is desired, engine oil pressure supplied to the apparatus is increased to approximately 50 psi, which is sufficient to overcome the force of the return spring and move the latching pin out of engagement with the inner finger arm. The outer finger arm continues to follow the surface of the single-lobed camshaft, but the cam motion is not translated to the inner finger arm, so the valve is not actuated thereby.

Alternatively, the pin may be engaged and disengaged by the direct action of an electric solenoid axially disposed at the outer end of the pin. For example, U.S. Pat. No. 5,653,198 discloses a latching pin engaged by a rotary or linear solenoid and disengaged by a return spring.

The disclosed linkages have several shortcomings, an important one of which is that the solenoids physically reside inside the cam cover of the engine. Therefore, the solenoids, connectors, and wiring components are exposed to high temperature engine oil which can be detrimental to connection reliability. It can be necessary to employ special insulation and sealing schemes to protect the components and connections from failure. Despite such special measures, it should be expected that such deactivation systems will experience an unacceptably high failure rate.

Further, a wiring harness is required to protect and organize the individual wires leading to the various solenoids, as well as a sealed port for the wiring harness to pass through the cam cover. The wiring harness is thus exposed to hostile conditions within the valve actuation chamber of the cam cover, making it prone to electrical failure.

Further, placing the solenoid actuator in a plane transverse of the engine and containing the finger follower and valve can cause the spark plug and plug well in the engine head to be displaced axially to a less desirable location along the head.

It is a principal object of the present invention to provide an improved apparatus for electromechanically actuating and deactuating the latching pin of a cam finger follower wherein the electromechanical portion of an actuating solenoid is mounted on the outside of the cam cover.

It is a further object of the invention to provide such apparatus wherein the actuating stroke of the solenoid may be offset from the axis of the latching pin to permit optimum placement of the spark plug within the cylinder head.

It is a still further object of the invention to provide such apparatus wherein the need for a separate wiring harness for all the pin-actuating solenoids on an engine is obviated.

SUMMARY OF THE INVENTION

Briefly described, a control system for variable activation of intake valves in an internal combustion engine in accordance with the invention includes a linear solenoid disposed on an outer surface of the intake valve cam cover and having the solenoid's armature extending through a sealing port in the cam cover into the valve actuation chamber. A bellcrank is mounted to the cam cover within the actuation chamber between the solenoid armature and the latching pin of a variable valve actuation apparatus such that energizing and de-energizing of the solenoid causes corresponding actuation and de-actuation of the latching pin. Preferably, for a plurality of such systems on an individual engine, the solenoids are provided with connecting pins on an upper surface thereof and are held in place by a formed plastic retainer, preferably containing an overmolded wiring bundle having exposed connectors placed to mate with the solenoid pins to automatically connect the embedded wiring harness properly to each solenoid upon installation of the retainer onto the engine.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
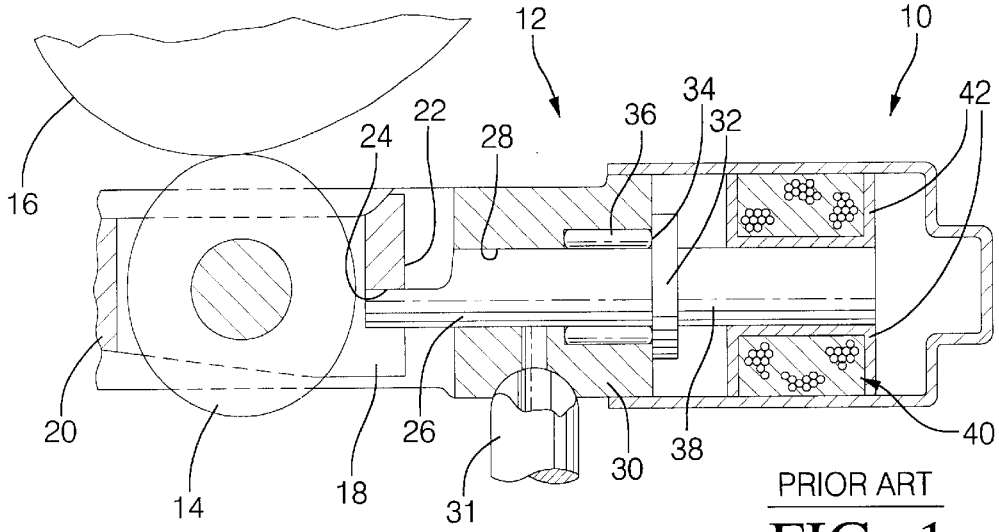
PRIOR ART FIG. 1
FIG. 1 is an elevational cross-sectional view of a prior art valve deactivation apparatus, showing a latching pin engageable by a coaxially mounted electric solenoid within a camshaft cover.
Figure 7:
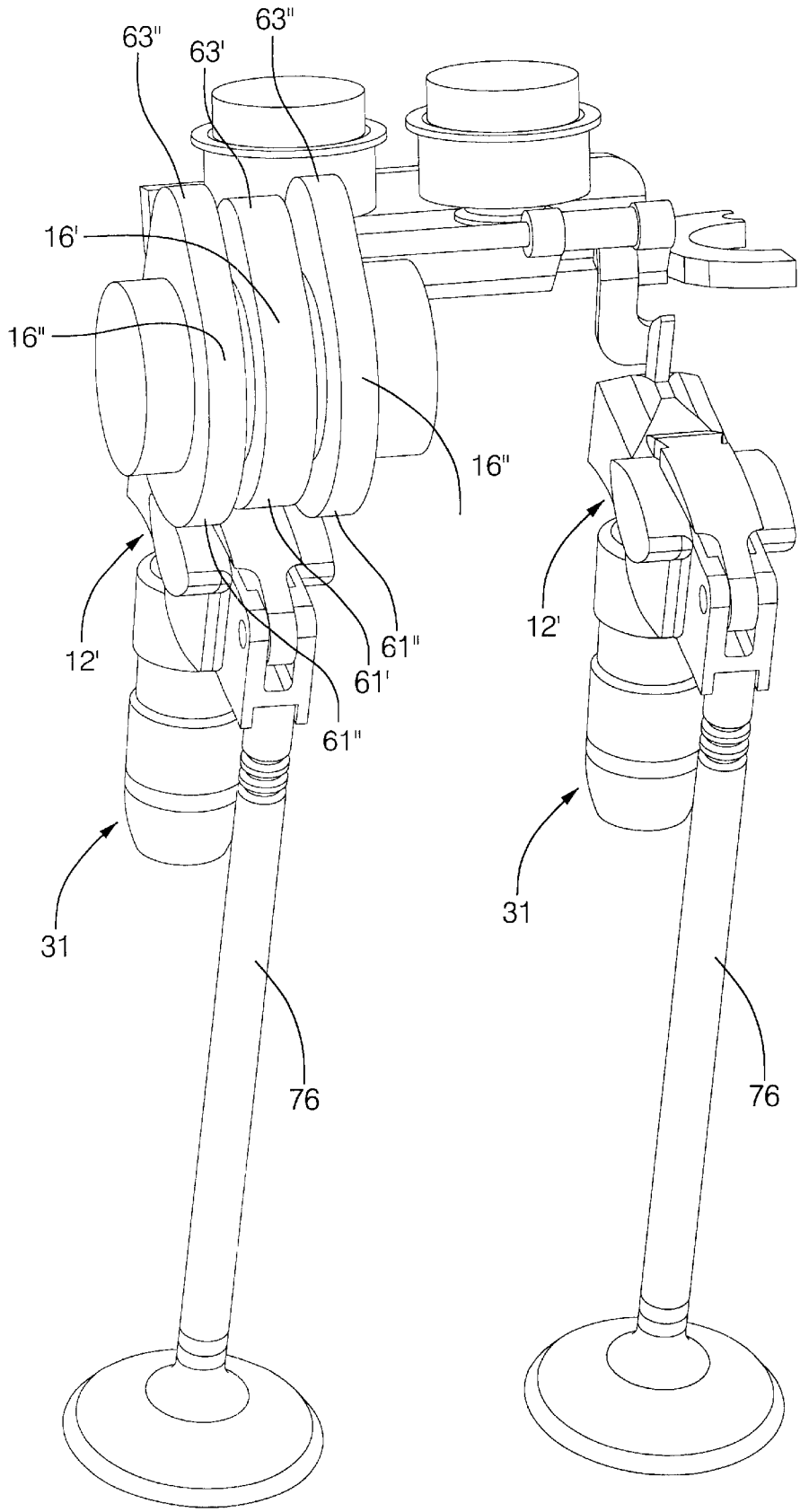
FIG. 7 is an isometric view similar to that shown in FIG. 5, showing a cam having a central high lift lobe and peripheral symmetrical low-lift lobes.

FIG. 1 shows a portion of a prior art valve deactivation apparatus 10 substantially in accordance with the disclosure of FIG. 7 in U.S. Pat. No. 5,544,626. A roller finger cam follower 12 has a roller 14 for following the eccentric surface of an engine cam 16. Follower 12 has an inner arm 18 supporting roller 14 and connected at a distal end 20 to a valve stem (not shown) for actuation thereof in response to rotation of cam 16. At proximal end 22, inner arm 18 has a latching surface 24 for releasably receiving a latching pin or plunger 26 disposed in a bore 28 in an outer arm 30 supported by a conventional hydraulic lash adjuster 31. Pin 26 is formed having a flared head 32 defining a stop for a return coil spring 34 disposed in a stepped portion 36 of bore 28. Pin 26 is further formed at its spring end with the armature 38 of an electromagnet assembly 40 which includes a solenoid 42 surrounding armature 38. When energized, assembly 40 moves the latching pin into the path of movement of inner arm 18 to the locking position shown to prevent inner arm 18 from free-wheeling. This renders the outer arm and the inner arm essentially integral for operation of the roller finger follower 12 in a conventional manner to actuate the engine valve train. When assembly 40 is de-energized, spring 34 urges pin 26 out of engagement with inner arm 18, thus de-actuating the engine valve train.

Referring to FIGS. 2 through 7, a valve deactivation apparatus 50 in accordance with the invention includes an electromagnet assembly 40' disposed on the raised rim 52 of a stepped port 54 formed in the "valley" of an engine camshaft cover 56. An important advantage of this configuration is that the electrical components of assembly 40' are located outside of the hot-oil environment within the camshaft cover. The camshaft cover shown is a combined cover for the intake valve cams 16' and the exhaust valve cams (not shown), and assembly 40' is centered on the longitudinal centerline of cover 56. Of course, it should be appreciated that other cover configurations wherein the electromagnet assembly is similarly disposed outside the valve train chambers formed within the cover, whether for only exhaust valves, only intake valves, or both, may be obvious to those of ordinary skill in the art of engine design and are therefore fully within the scope of the invention.

Figure 6:
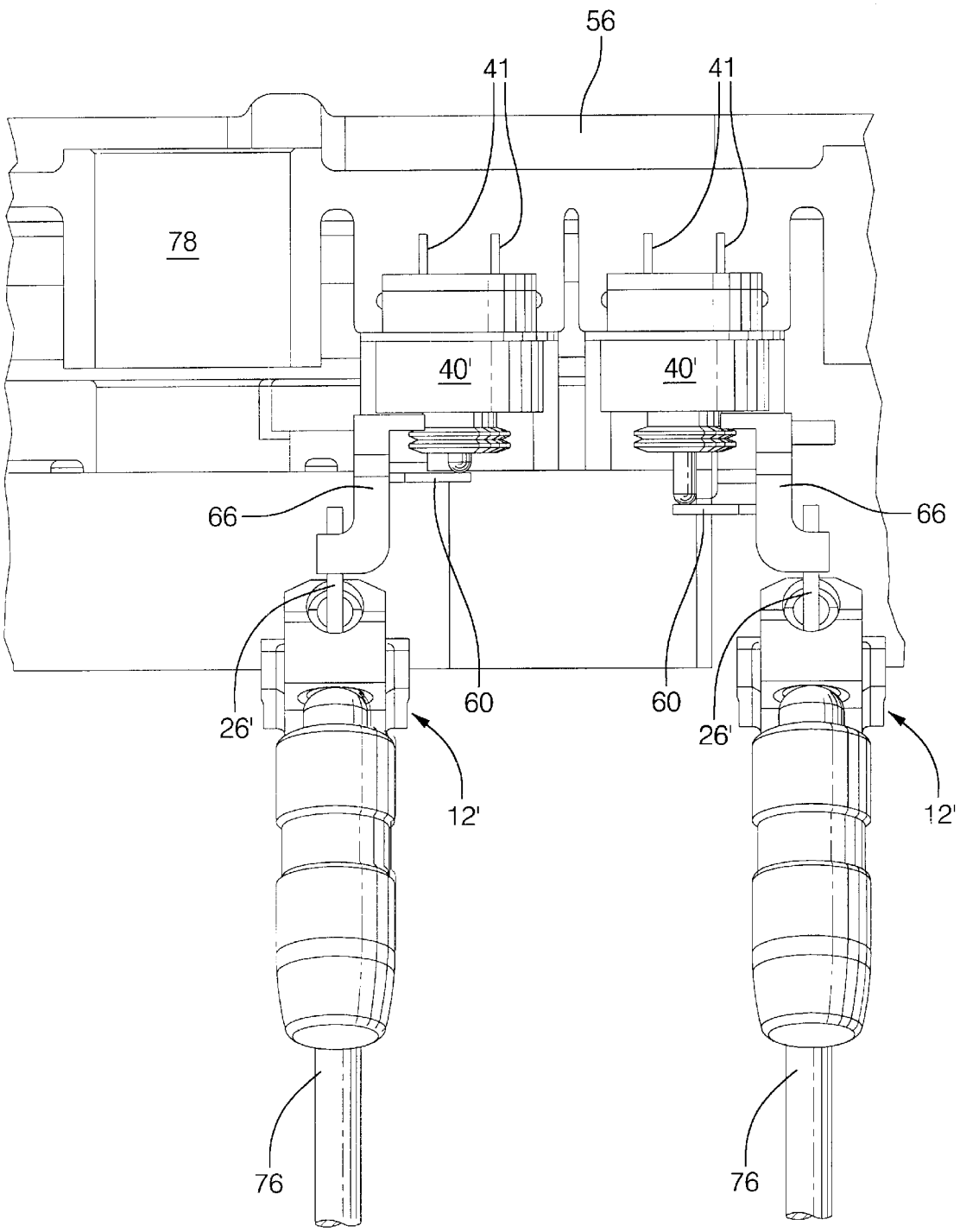
FIG. 6 is an elevational view of the apparatus shown in FIG. 5, showing how the offset between the actuators and the valves accommodates optimum positioning of the spark plug wells for each cylinder.

Preferably, each assembly 40' for a given engine 44 is provided with electrical connecting pins 41 protruding upwards from an upper surface thereof (see FIG. 6, for example). An assembly retainer 43 is formed as a single unit to fit over the plurality of assemblies 40' and to hold them firmly in place during operation of the engine. Retainer 43 also provides the normal force required to prevent oil leakage across rim 52. Retainer 43 is attached to the cam cover preferably via a plurality of bolts (not shown). Preferably, retainer 43 includes a wiring harness 45 encapsulated within a plastic shell as by overmolding in known fashion and having connectors exposed at the correct locations to mate with each set of pins 41. Thus each electromagnetic assembly may be automatically connected properly to a source of power and engine logic by retainer 43.

Assembly 40' which extends through port 54 is preferably sealed against rim 52 to prevent leakage of oil from port 54. An armature 38' extends from assembly 40' through a shaft seal 58 to engage a first arm 60 of a bellcrank 62 pivotably mounted on a pivot post 64 attached to cover 56. A second arm 66 of bellcrank 62 engages a latching pin 26' for a cam finger follower 12', similar to follower 12. When assembly 40' is energized, latching pin 26' is engaged within follower 12' to unify an inner arm 18' and an outer arm 30', similar to the action of pin 26 in unifying an inner arm 18 and an outer arm 30 as described above. When assembly 40' is de-energized, latching pin 26' is disengaged from the inner arm by a spring 34' appropriately disposed within follower 12'.

Figure 3:
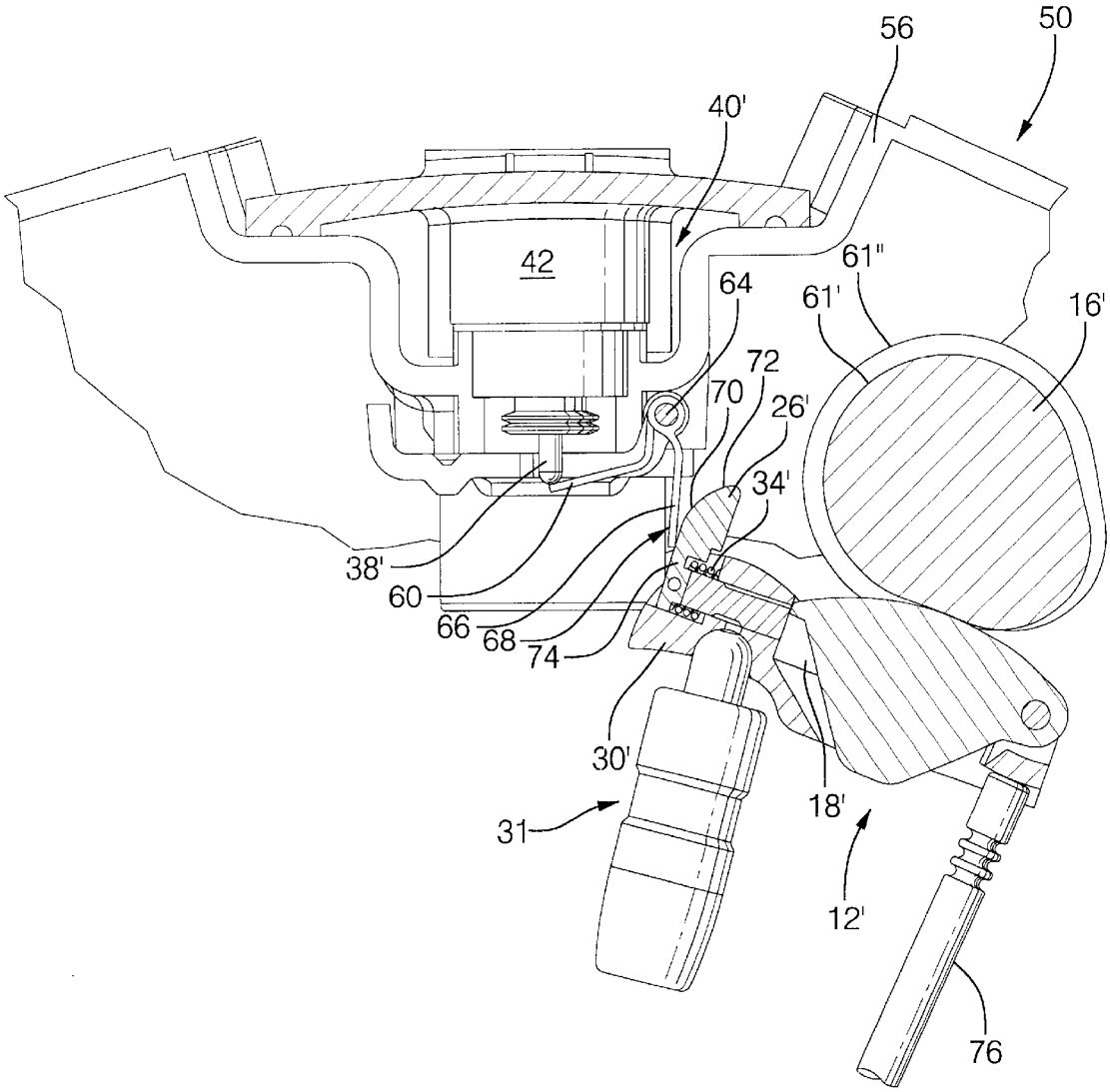
FIG. 3 is a view operationally sequential to that shown in FIG. 2 wherein the solenoid has been energized and the bellcrank has been compressed in preparation for engagement of the latching pin to activate the system to high lift mode during the next rotational cycle of the camshaft.
Figure 4:
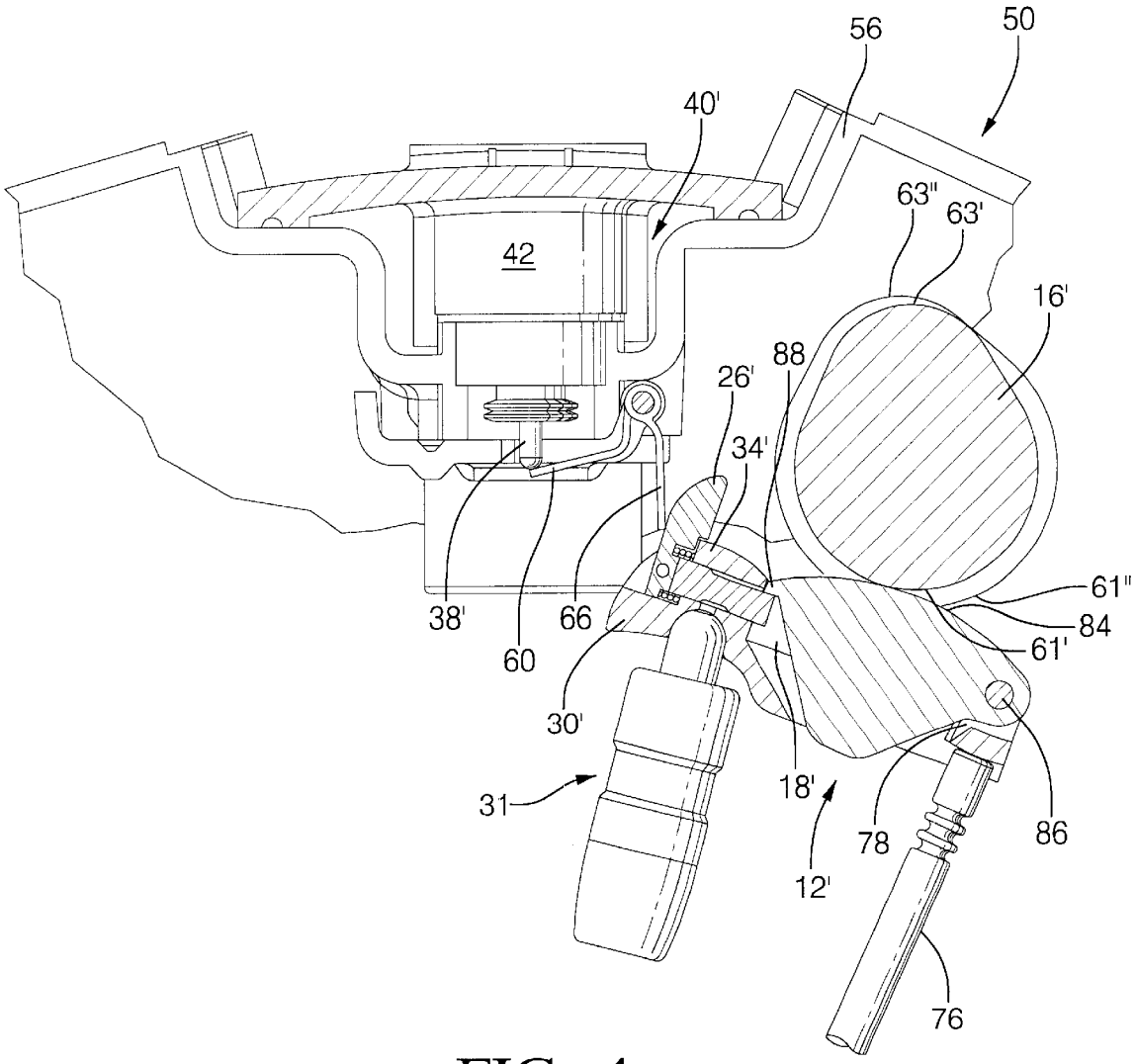
FIG. 4 is a view operationally sequential to that shown in FIG. 3 wherein the latching pin has been engaged into the follower slider by decompression of the bellcrank.

Preferably, at least one of arms 60,66 of bellcrank 62 is resiliently flexible and has sufficient spring force when flexed to overcome the opposing force of the disengaging spring 34'. This permits the solenoid assembly to be energized at any time without regard to the timing of the cam rotary cycle. The flexed bellcrank arm will "cock" the latching pin 26' such that the pin will be engaged into the inner arm 18' at the first instant that the follower returns to the base circle portion 61' of the cam, as shown in FIGS. 3 and 4. This simplifies the engine control logic and makes unnecessary any tracking of the position of the cam in order to time the energizing of the solenoid assembly.

Figure 2:
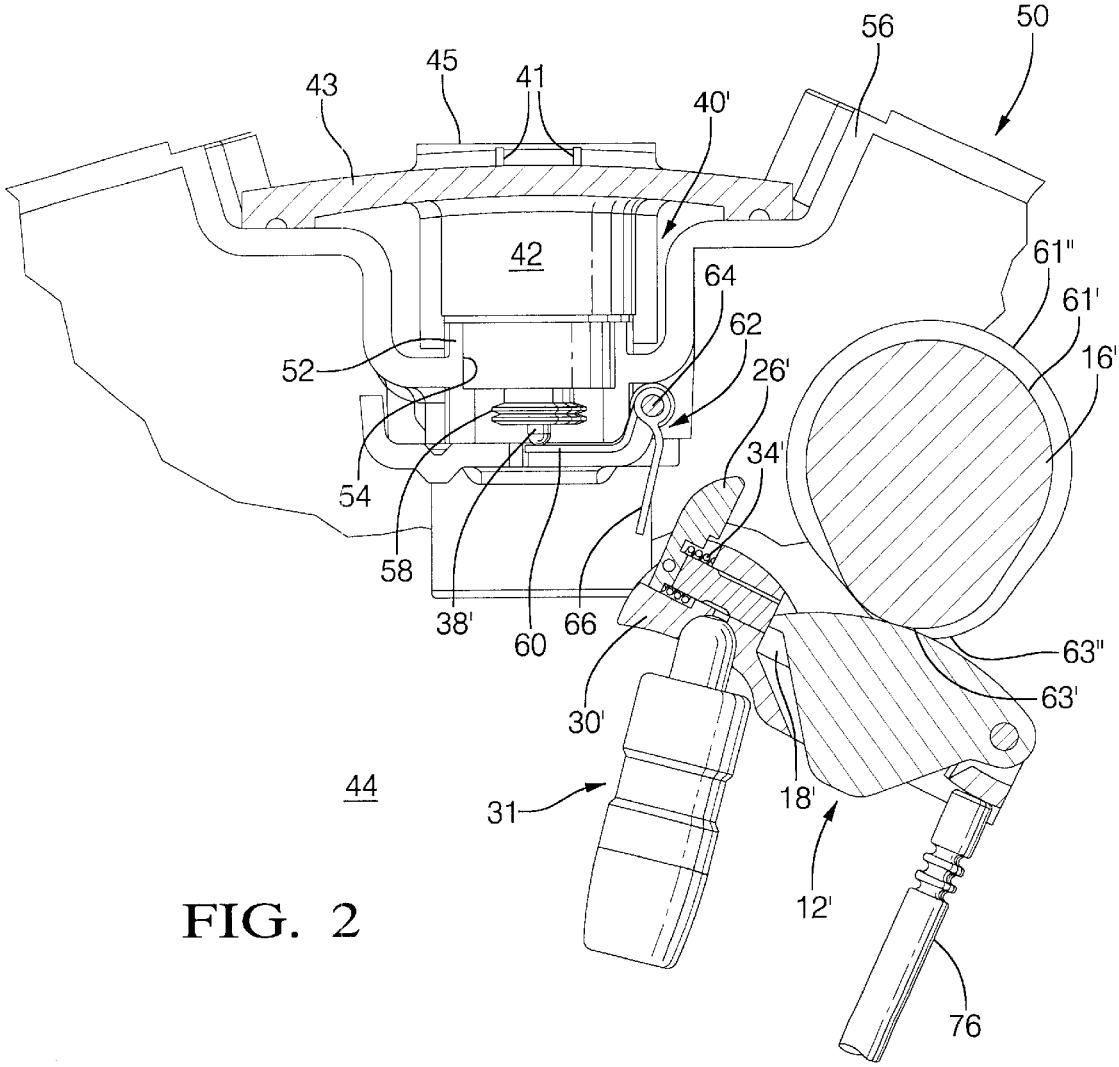
FIG. 2 is an elevational cross-sectional view of a control system for variable actuation of a valve between high lift and low lift modes in accordance with the invention, showing a de-energized solenoid mounted outside the valve chamber and showing a latching pin in disengaged position from the follower slider (system in low-lift mode)

In operation, beginning with the solenoid de-energized and the pin disengaged, as shown in FIG. 2, in a first step the solenoid is energized and the armature is extended to rotate the bellcrank counterclockwise, as shown in FIG. 3. If the follower is on the eccentric portion 63' of the cam surface, the bellcrank becomes slightly compressed (flexure of one or both arms and/or reduction in the included angle therebetween), cocking the latching pin in preparation for subsequent insertion. Preferably, the surface 68 of the latching pin 26' which is engaged by arm 66 is non-planar and includes a ramp 70 having an upper portion 72 and a lower portion 74. This feature causes the bellcrank to be further compressed by the counterclockwise rotary motion of the follower in returning to the base circle portion 61' of the cam, adding to the engagement force exerted by the bellcrank on the latching pin. As shown in FIG. 4, the latching pin 26' is engaged into the inner arm 18' when the follower returns to the base circle portion 61' of the cam, and the latching pin remains engaged so long as the solenoid remains energized. In fact, even when the solenoid is de-energized, the latching pin remains engaged as long as it is under shear force exerted by the eccentric portion 63' of the cam lobe 16, and will snap out of engagement in response to spring 34' only when the follower returns to the base circle portion of the cam lobe, relieving the shear force on the latching pin.

Figure 5:
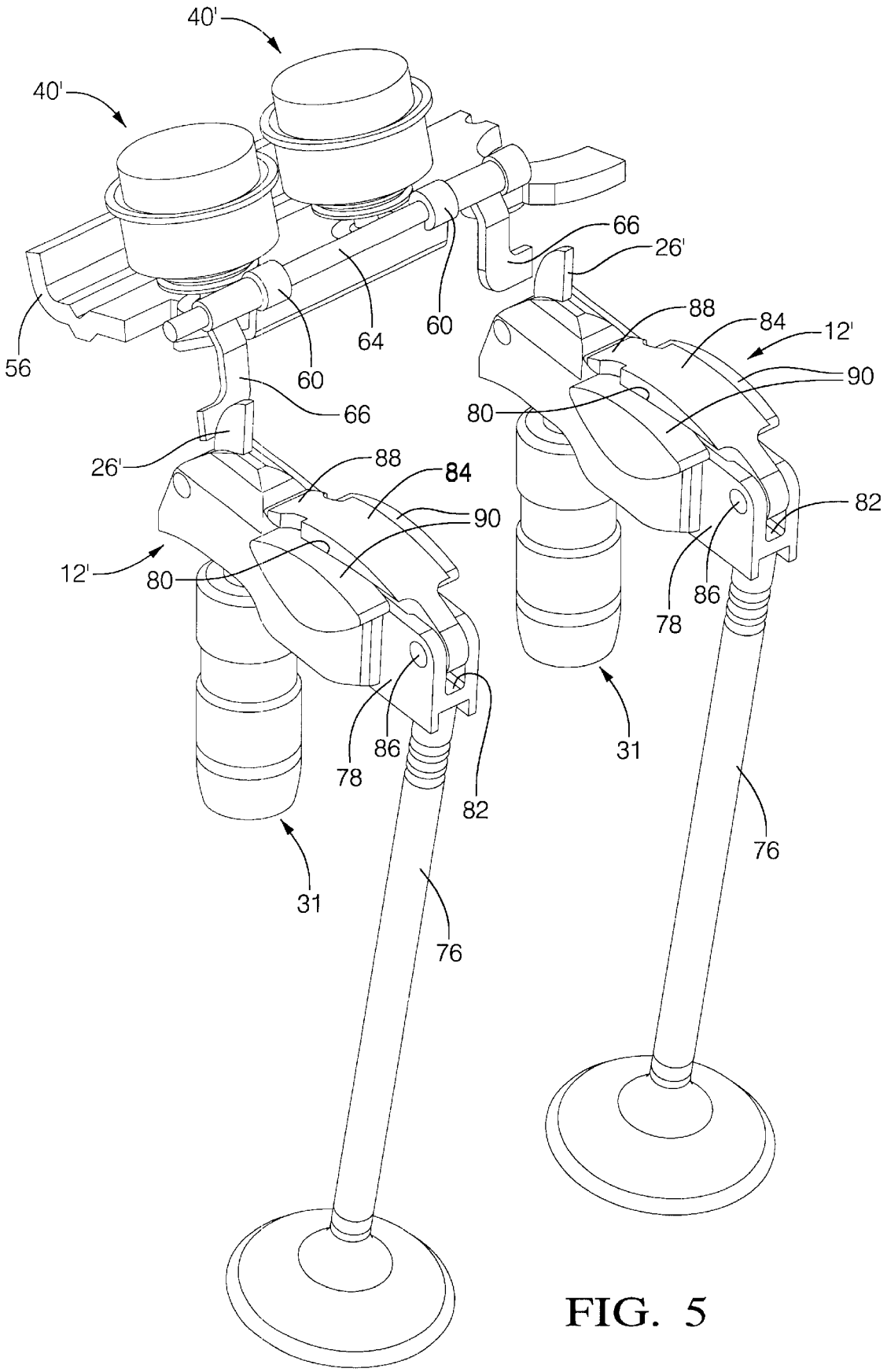
FIG. 5 is an isometric view from above of adjacent valves having mirror image actuating systems in accordance with the invention wherein the solenoid actuators are offset from the finger followers (cams omitted for clarity)

Referring to FIGS. 5 and 6, an important advantage of locating the electromechanical actuation assembly 40' off-axis from the follower 12' and outside of cover 56 is that the assembly 40' may be displaced longitudinally of the cover simply by providing an axial offset in the bellcrank between the first and second arms 60,66. Thus, as shown, assemblies 40' for adjacent valves 76 may be grouped together longitudinally of the cover to share a common pivot post 64 and to make room for optimum placement of the spark plug wells 78 in the cover and therefore in the engine head.

Further, it should be understood that while the system as described and shown herein includes a finger follower having a latch pin engageable by the action of an electric solenoid and disengageable by the action of a return spring, other systems wherein a latch pin is disengageable by the action of a solenoid and is engageable by the action of a return spring are also fully comprehended by the invention.

Referring further to FIGS. 5 and 7 (and as shown in cross-section in FIGS. 2 through 4), apparatus in accordance with the invention may be readily adapted to include a high-lift/low-lift cam and a corresponding high-lift/low-lift finger follower. Cam 16 includes a high-lift central cam lobe 16', having an eccentric portion 63' and a base circle portion 61', and two low-lift peripheral cam lobes 16" symmetrically disposed on either side of lobe 16' and having eccentric portions 63" and base circle portions 61". Follower 12' comprises an inflexible frame 78 pivotably supported by lash adjuster 31 and vertically oscillable thereupon to actuate valve stem 76. Frame 78 includes a central aperture 80 and connected slot 82 for receiving high-lift slider 84. Slider 84 is pivotably disposed in aperture 80 and slot 82 about pivot pin 86. Slider 84 has a nose portion 88 for engaging with latching pin 26'. Follower 12' further comprises two integral low-lift sliders 90 disposed on either side of aperture 80.

In operation, when latching pin 26' is disengaged from nose portion 88, high-lift slider 84 pivots about pin 86 in response to actuation by cam lobe 16' without causing actuation of frame 78; thus, no high-lift valve actuation is provided. Simultaneously, low-lift cam lobes 16" ride on low-lift sliders 90, providing low-lift actuation of valves 76. When latching pin 26' is engaged into nose portion 88, high-lift slider 84 is locked to frame 78 such that high-lift cam lobe 16' causes high lift of valves 76; low-lift lobes 16" are disengaged from low-lift sliders 90 during the actuation portion of the camshaft rotation.

While the invention has been described by reference to various specific embodiments, it should be understood that numerous changes may be made within the spirit and scope of the inventive concepts described. For example, one or all of the high-lift and low-lift sliders 84,90, respectively, may be replaced by rollers as is known in the art. Accordingly, it is intended that the invention not be limited to the described embodiments, but will have full scope defined by the language of the following claims.

What is claimed is:

1. A control system for activation and deactivation of valves in a multiple-cylinder internal combustion engine, comprising:

a finger follower disposed in said engine including a movable latch pin for actuating and deactuating said follower's response to a cam of said engine;

an electromechanical actuator disposed on an outer surface of a camshaft cover of said engine and extending through a port in said cover for variably actuating said latch pin;

a bellcrank pivotably disposed between said latch pin and said actuator;

said bellcrank includes first and second arms having a common axis of rotation; and at least one of said arms of said bellcrank is flexibly resilient.

2. A control system in accordance with claim 1 wherein said first arm is axially offset along said common axis of rotation from said second arm.

3. A control system in accordance with claim 2 wherein said first arm is responsive to said actuator and said second arm is actuative of said latch pin.

4. A control system in accordance with claim 1 further comprising a retainer for retaining said actuator on said cam cover, wherein said retainer includes a wiring harness encapsulated therein for providing electric power to said actuator.

5. A control system in accordance with claim 1 wherein said actuator is offset axially of said engine from said finger follower.

6. An internal combustion engine having a control system for deactivation of valves, comprising:

a finger follower including a movable latch pin for actuating and deactuating said follower's response to a cam of said engine;

an electromechanical actuator disposed on an outer surface of a camshaft cover of said engine and extending through a port in said cover for variably actuating said latch pin;

a bellcrank pivotably disposed between said latch pin and said actuator;

said bellcrank includes first and second arms having a common axis of rotation; and at least one of said arms of said bellcrank is flexibly resilient.

* * * * *